US007942733B2

(12) United States Patent
Sakuma

(10) Patent No.: US 7,942,733 B2
(45) Date of Patent: May 17, 2011

(54) SLOT MACHINE THAT SETS FREE GAME WHEN PREDETERMINED CONDITION IS SATISFIED

(75) Inventor: Hiro Sakuma, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 735 days.

(21) Appl. No.: 12/068,811

(22) Filed: Feb. 12, 2008

(65) Prior Publication Data

US 2008/0227528 A1 Sep. 18, 2008

(30) Foreign Application Priority Data

Feb. 13, 2007 (JP) ..... P2007-032464

(51) Int. Cl.
*A63F 9/24* (2006.01)

(52) U.S. Cl. ..... 463/20; 463/16; 463/25

(58) Field of Classification Search ..... 463/20, 463/16, 25

See application file for complete search history.

(56) References Cited

U.S. PATENT DOCUMENTS

| | | | | |
|---|---|---|---|---|
| 7,037,191 | B2 * | 5/2006 | Rodgers et al. | 463/16 |
| 2009/0227335 | A1 * | 9/2009 | Inamura | 463/20 |
| 2009/0227358 | A1 * | 9/2009 | Yoshizawa | 463/21 |
| 2009/0239647 | A1 * | 9/2009 | Kuwana | 463/20 |
| 2009/0305764 | A1 * | 12/2009 | Kato et al. | 463/20 |
| 2009/0312089 | A1 * | 12/2009 | Tsukahara | 463/20 |
| 2010/0048286 | A1 * | 2/2010 | Okada et al. | 463/20 |
| 2010/0304820 | A1 * | 12/2010 | Okada | 463/16 |
| 2010/0304846 | A1 * | 12/2010 | Ogino et al. | 463/25 |

* cited by examiner

*Primary Examiner* — Pierre E Elisca
(74) *Attorney, Agent, or Firm* — McGinn IP Law Group, PLLC

(57) ABSTRACT

A slot machine includes: a display device that is defined with a plurality of symbol display areas in which one of a plurality of types of symbols including a special symbol is displayed; an operation unit; and a game controller that operates to: accept a bet of a game value on any one or more of a plurality of bet areas; determine the symbols to be displayed stopped in each of the symbol display areas; control the display device to display the determined symbols stopped in each of the symbol display areas after being variably displayed; set a free game for the bet areas on which the bet is accepted and the special symbol is displayed stopped; and accept a next bet on any one or more of the bet areas for which the free game is not set.

3 Claims, 13 Drawing Sheets

FIG. 9

| SYMBOL COMBINATION | AMOUNT OF AWARD |
|---|---|
| BLUE 7 - BLUE 7 - BLUE 7 | 100 |
| RED 7 - RED 7 - RED 7 | 100 |
| BLUE 7 - RED 7 - ANY | 100 |
| BAR - BAR - BAR | 50 |
| EIGHT - EIGHT - EIGHT | 30 |
| BELL - BELL - BELL | 20 |
| WATER MELON - WATER MELON - WATER MELON | 20 |
| PLUM - PLUM - PLUM | 10 |
| ORANGE - ORANGE - ORANGE | 10 |
| CHERRY - CHERRY - CHERRY | 5 |

FIG. 10

| PATTERN | CONTENT OF AWARD |
|---|---|
| BONUS SYMBOL | AWARD OF BONUS GAME |
| BLUE 7 | x 20 |
| RED 7 | x 20 |
| BAR | x 10 |
| EIGHT | x 5 |
| BELL | x 3 |
| WATER MELON | x 3 |
| PLUM | x 2 |
| ORANGE | x 2 |
| CHERRY | x 1 |
| BLANK | x 0 |

SLOT MACHINE THAT SETS FREE GAME WHEN PREDETERMINED CONDITION IS SATISFIED

CROSS-REFERENCE TO THE RELATED APPLICATION(S)

The present application is based upon and claims priority from prior Japanese Patent Application No. 2007-032464, filed on Feb. 13, 2007, the entire content of which are incorporated herein by reference.

TECHNICAL FIELD

The present invention relates to a slot machine capable of providing a free game, for which a bet is automatically set on the basis of a previous bet without consuming any game value, in a case where a predetermined condition is satisfied, and more particularly, to a slot machine allowing a player to be involved in a free game in a case where the free game is performed.

BACKGROUND

Slot machines are provided with a plurality of reels that are rotatably disposed and have a plurality of types of symbols marked on peripheral surfaces thereof. When a predetermined game value (for example, credits or the like) is betted and a predetermined operation (for example, an operation of a start button or a start lever) is performed, symbols are variably displayed in accordance with rotation of the reels. Generally, a bet of a game value is placed for pay lines defined over the plurality of the reels or all the symbols stopped to be displayed on the plurality of the reels.

When a predetermined time elapses after the symbols are variably displayed, symbols of each reel are stopped to be displayed on the basis of the result of an internal lottery. Then, an award on the basis of a combination of the symbols stopped to be displayed and the content of the bet is provided to a player.

Other than the above-described mechanical slot machines, there are video slot machines that use video reels for simulating mechanical reels. The video slot machines represent video reels by variably displaying symbol arrays including a plurality of types of symbols on a display device. In the video slot machines, as in the mechanical slot machines, symbols are variably displayed by using the video reels, and an award on the basis of a combination of the symbols stopped to be displayed and the content of the bet is provided to the player.

As described above, in the slot machines, an award is provided to a player on the basis of the combination of symbols and the content of the bet. As the content of the award, for example, a game value may be given as an award or a chance for participating in a special game, which is performed in a state more advantageous to the player than that of a base game, may be provided.

An example of thus configured slot machine for providing a change for participating in a special game as the content of the award is disclosed in U.S. Pat. No. 7,037,191 B2.

In the slot machine disclosed in the document U.S. Pat. No. 7,037,191 B2, symbols are variably displayed by using five reels, and, after a predetermined time elapses, symbols determined by an internal lottery are stopped to be displayed. Then, an award on the basis of the symbols stopped to be displayed is provided to the player.

In the slot machine disclosed in the document U.S. Pat. No. 7,037,191 B2, a change for the player to be involved in performance of the special game is provided to the player as an award in a case where the symbols stopped to be displayed form a predetermined combination. In the special game, 12 choices are displayed on the display of the slot machine. Then, the player selects one of the choices. When the result of the choice satisfies a predetermined condition, a high game value is given to the player. In other words, according to thus configured slot machine, a player can have a change for acquiring a high game value by playing the special game.

In slot machines, as a special game provided as the content of an award, so called a "free game" other than the game disclosed in the document U.S. Pat. No. 7,037,191 B2 has been known. In this free game, when a predetermined condition is satisfied, a same bet mode as the previous bet mode (that is, a bet mode used at a time when the predetermined condition is satisfied) is set and a slot game is performed without consuming any game value. Since a player can acquire an award during the free game without spending any game value by playing the free game, the free game is advantageous to the player.

As described above, since the bet mode of the free game is set on the basis of the previous bet mode, the player cannot be involved in the free game at all. In other words, during the free game, the player only watches symbols variably displayed and symbols stopped to be displayed.

SUMMARY

One of objects of the present invention is to provide a slot machine allowing a player to be involved in a free game in a case where the free game is performed.

According to a first aspect of the invention, there is provided a slot machine that provides a slot game to a player, the slot machine including: a display device that is defined with a plurality of symbol display areas in which one of a plurality of types of symbols including a special symbol is respectively displayed stopped after being variably displayed; an operation unit that allows the player to input commands for playing the slot game; and a game controller that operates to: accept a bet of a game value on any one or more of a plurality of bet areas that are defined to include the symbol display areas in accordance with the commands input to the operation unit by the player; determine the symbols to be displayed stopped in each of the symbol display areas; control the display device to display the determined symbols stopped in each of the symbol display areas after being variably displayed; determine an award based on the symbols displayed stopped in the bet areas on which the bet is accepted; provide the determined award to the player; set a free game for the bet areas on which the bet is accepted and the special symbol is displayed stopped; and accept a next bet on any one or more of the bet areas for which the free game is not set.

According to a second aspect of the invention, there is provided a slot machine that provides a slot game to a player, the slot machine including: a display device that is provided with a plurality of reel display sections having symbol display area in which one of a plurality of types of symbols including a special symbol is respectively displayed stopped after being variably displayed; an operation unit that allows the player to input commands for playing the slot game; and a game controller that operates to: accept a bet of a game value on any one or more of the reel display sections; determine the symbols to be displayed stopped in each of the reel display sections; control the display device to display the determined symbols stopped in each of the reel display sections after being variably displayed; determine an award based on the symbols displayed stopped in the reel display sections on which the bet is accepted; provide the determined award to the player; set a free game for the reel display sections on which the bet is accepted and the special symbol is displayed stopped; and accept a next bet on any one or more of the reel display sections for which the free game is not set.

According to a third aspect of the invention, there is provided a slot machine that provides a slot game to a player, the slot machine including: a display device that is defined with a plurality of symbol display areas in which one of a plurality of types of symbols including a special symbol is respectively displayed stopped after being variably displayed; an operation unit that allows the player to input commands for playing the slot game; and a game controller that operates to: accept a bet of a game value on any one or more of a plurality of pay lines that are defined to include the symbol display areas in accordance with the commands input to the operation unit by the player; determine the symbols to be displayed stopped in each of the symbol display areas; control the display device to display the determined symbols stopped in each of the symbol display areas after being variably displayed; determine an award based on the symbols displayed stopped on the pay lines on which the bet is accepted; provide the determined award to the player; set a free game for the pay lines on which the bet is accepted and the special symbol is displayed stopped; and accept a next bet on any one or more of the pay lines for which the free game is not set.

BRIEF DESCRIPTION OF THE DRAWINGS

In the accompanying drawings:

FIG. 9 is a schematic diagram showing a first award determination table according to the embodiment;

FIG. 10 is a schematic diagram showing a second award determination table according to the embodiment;

DETAILED DESCRIPTION

Hereinafter, a gaming machine according to the present invention will be described in detail on the basis of an embodiment implemented as a slot machine with reference to the accompanying drawings.

Here, a slot machine according to the embodiment is so called a video slot machine that has an image display device, such as a liquid crystal display, and performs a game by variably displaying and stopping images of various symbols in the image display device.

First, an overview of a game performed by a slot machine 1 according to the embodiment will be described in detail with reference to the accompanying drawings.

In the slot machine 1 according to the embodiment, a main CPU 41 accepts a bet of a game value for each bet area (that is, a reel display area or a pay line) in a start reception process (S11) to be describer later. When a game is started, symbols are variably displayed in each reel display area, and symbols determined in a symbol determination process (S12) is stopped to be displayed in each reel display area (S13). Then, in the slot machine 1, in an award determination process (S14), the content of an award on the basis of the symbols stopped to be displayed in the bet area (hereinafter, referred to as an award determination area) for which a bet of a game value is placed is determined, and the content of the award is provided to a player.

When the symbol stopped to be displayed in a reel display area serving as the award determination area is a bonus symbol 101, in a bonus game process (S16), a "free game" is set for the bet area as a bonus game (S51). In other words, the number of bets placed in a game in which the bonus symbol 101 is stopped to be displayed is set as the number of bets for the bet area (hereinafter, referred to as a bonus area), in which the bonus symbol 101 is stopped to be displayed, in games performed a predetermined number of times. In that case, any credit owned by the player is not consumed at all.

In addition, in the bonus game process (S16), the player can arbitrary place a bet of a game value for each bet area other than the bonus area from among the bet areas (S54 to S58).

Figure 2:
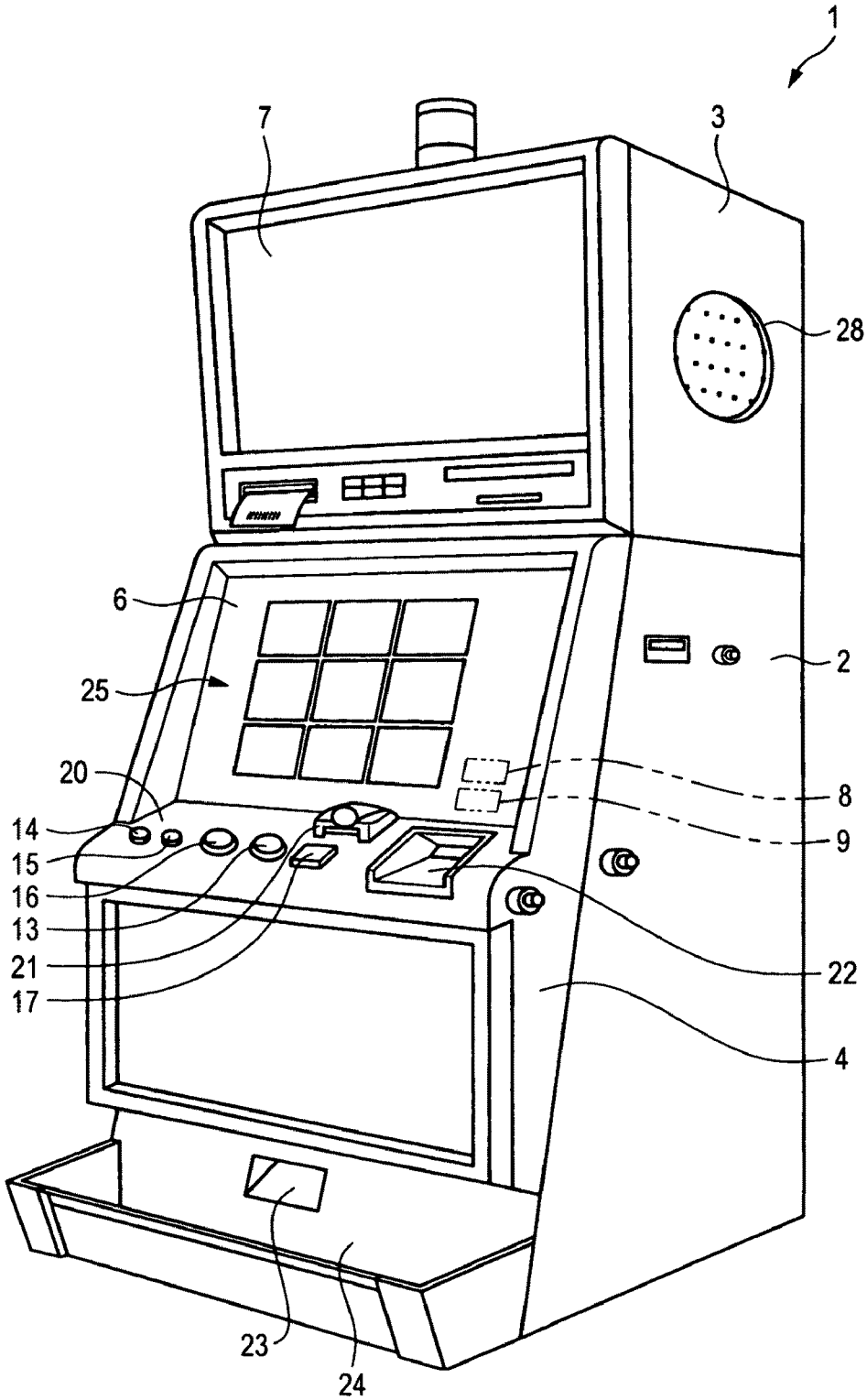
FIG. 2 is an external perspective view of a slot machine according to the embodiment.

Next, the schematic configuration of a slot machine 1 according to the embodiment will be described with reference to the accompanying drawings. FIG. 2 is an external perspective view of the slot machine according to the embodiment.

The slot machine 1 according to the embodiment is provided with a cabinet 2, a top box 3, and a main door 4.

The top box 3 is installed above the cabinet 2. On the front side of the top box 3, an upper image display panel 7 is disposed. On the upper image display panel 7, for example, an award table, a description of a game, and the like are displayed. On the side of the top box 3, a speaker 28 that outputs sound is disposed.

The main door 4 is provided on the front face of the cabinet 2. In the main door 4, a lower image display panel 6 is disposed.

The lower image display panel 6 is a liquid crystal display. In the lower image display panel 6, as shown in FIGS. 2 and 3, a credit display section 8, a payout display section 9, first to ninth reel display areas 31 to 39, a reel bet display section 18, and a line bet display section 19 are formed.

In the slot machine 1 according to the embodiment, nine reel display areas are formed in the center of the lower image display panel 6. As shown in FIG. 3, among the nine reel display areas, three reel display areas formed on the left side, viewed from the front side, are referred to as a first reel display area 31, a second reel display area 32, and a third reel display area 33, from the upside. In addition, three reel display areas formed in the center are referred to as a fourth reel display area 34, a fifth reel display area 35, and a sixth reel display area 36, from the upside. In addition, three reel display areas formed on the right side, viewed from the front side, are referred to as a seventh reel display area 37, an eighth reel display area 38, and a ninth reel display area 39, from the upside.

Figure 3:
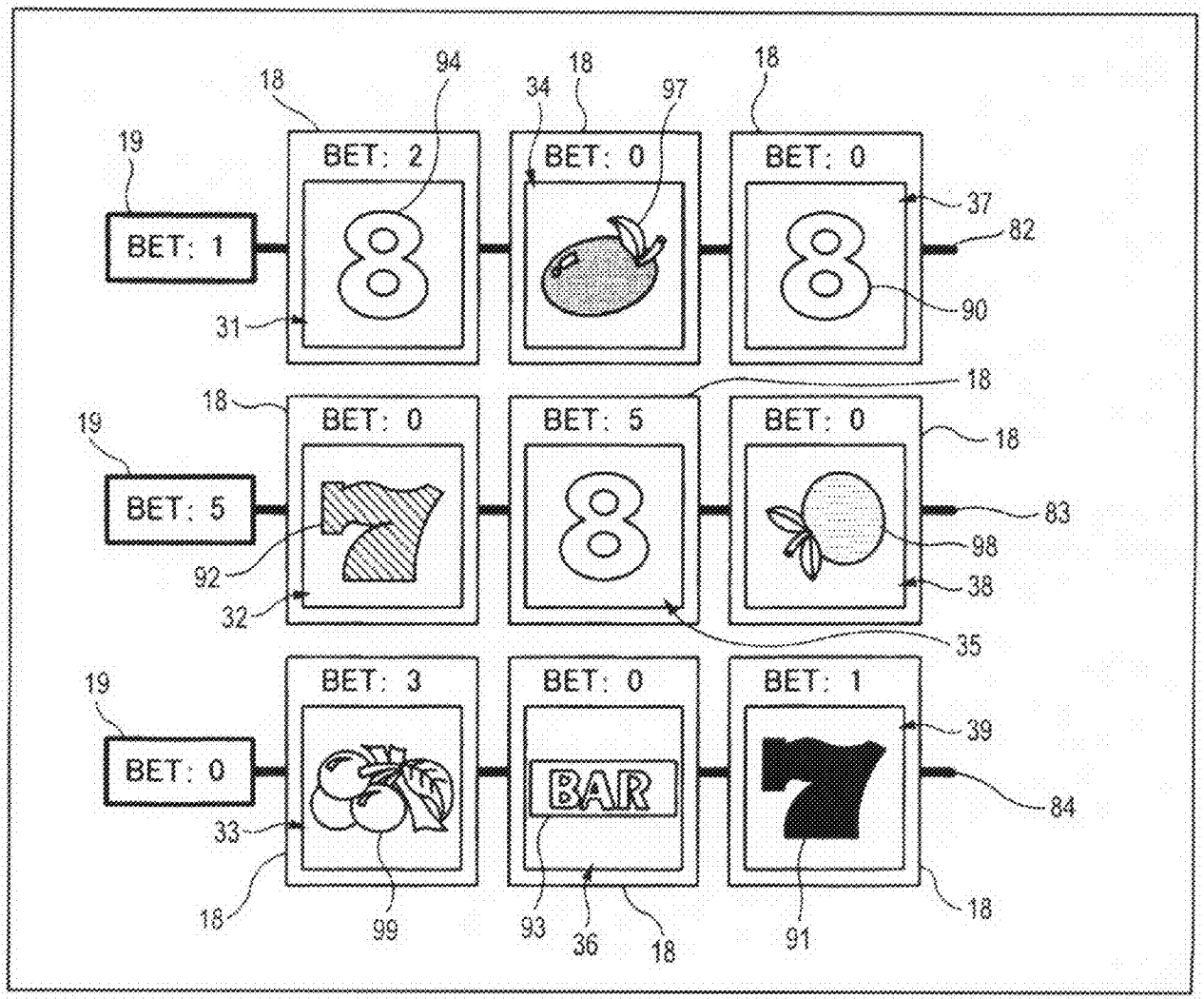
FIG. 3 is a diagram for describing reel display areas and pay lines according to the embodiment.

In each reel display area, symbols are variably displayed and a symbol is stopped to be displayed, on the basis of an operation performed by a player using video reels (see FIG. 3).

Figure 12:
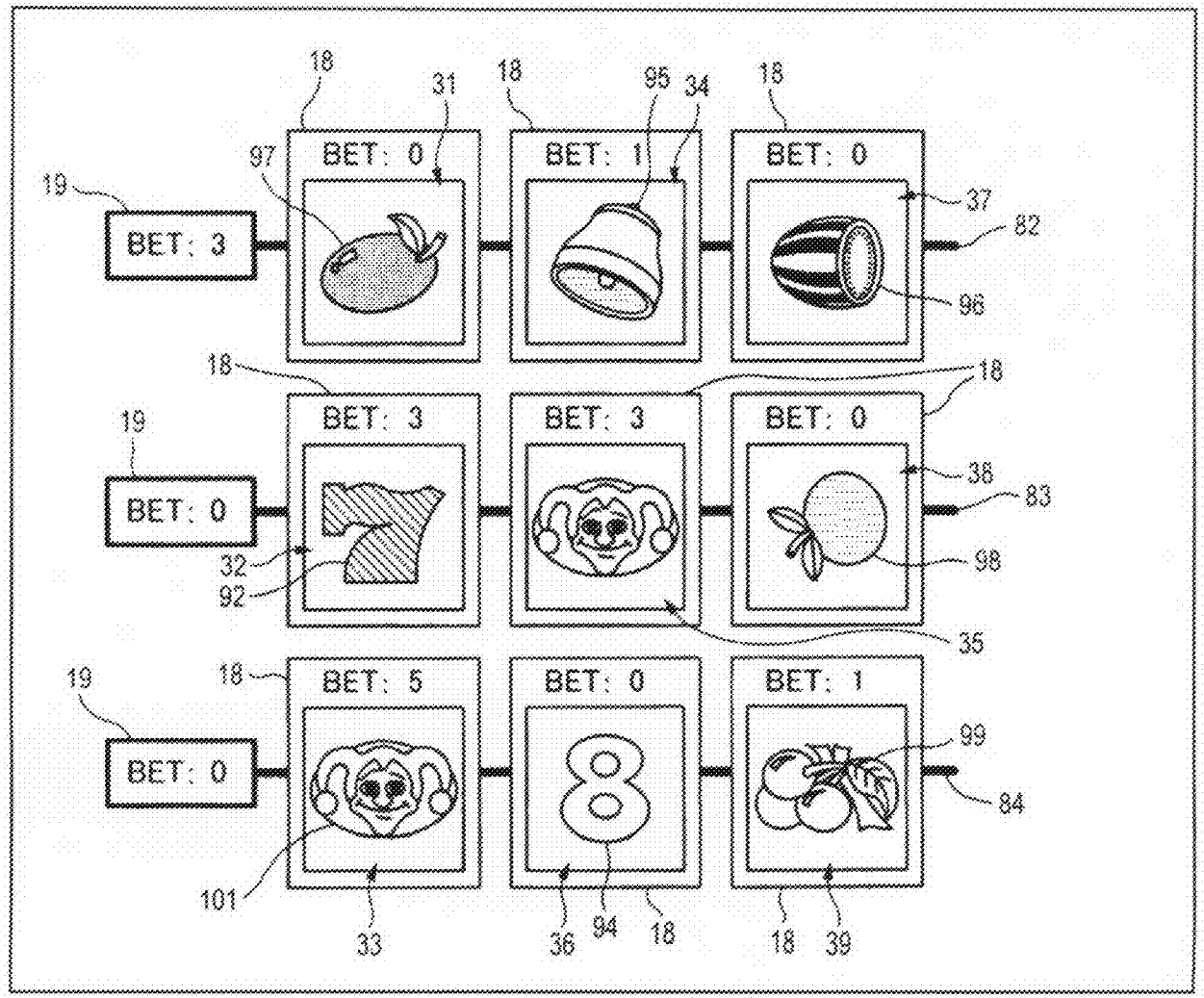
FIG. 12 is a diagram showing a lower image display panel according to the embodiment at a time when transition to a bonus game process is made.
Figure 13:
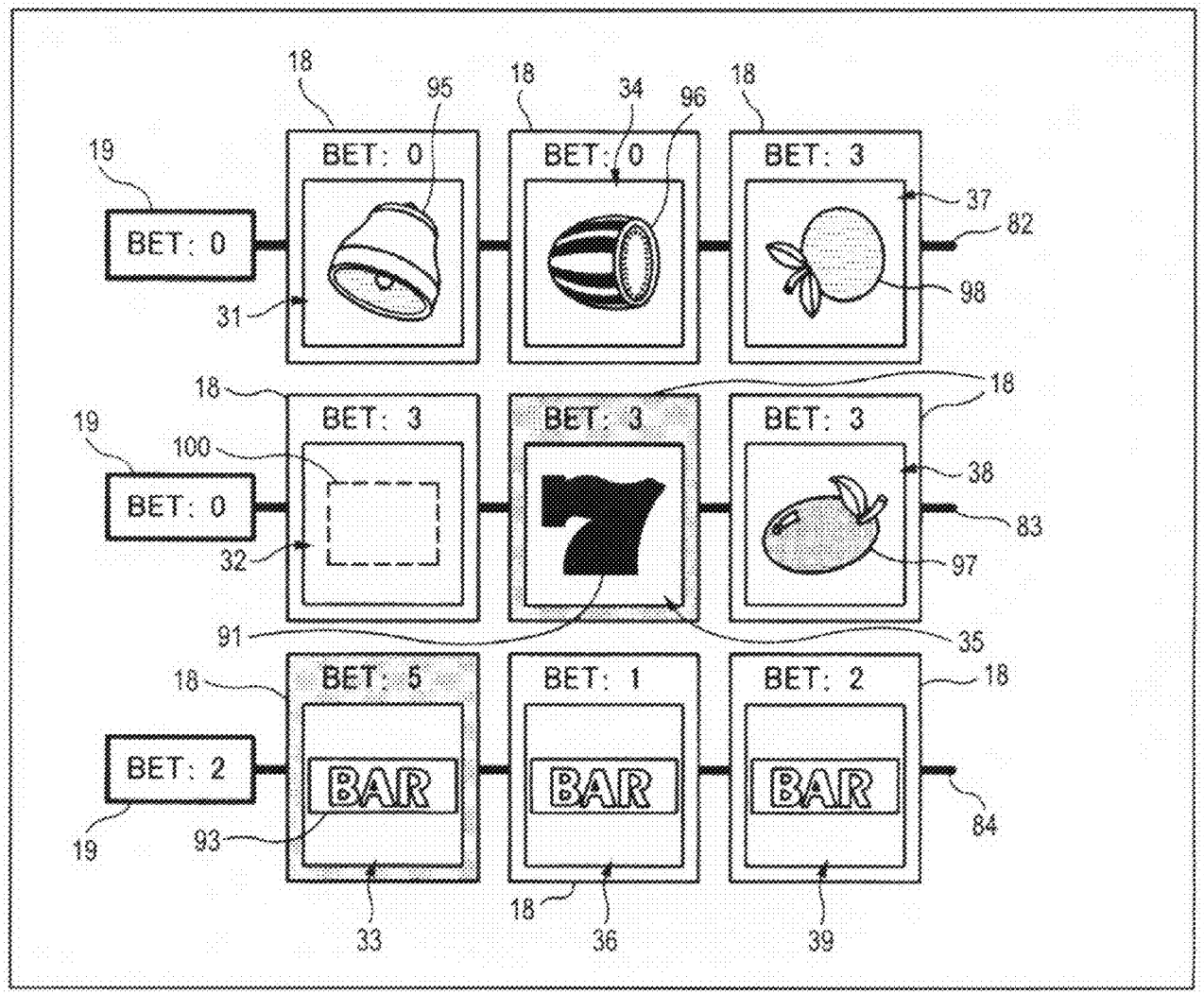
FIG. 13 is a diagram showing the lower image display panel at a time when a bonus game process is performed.

Here, the video reel of the slot machine 1 is formed by eleven types of patterns including "BLUE 7" 91, "RED 7" 92, "BAR" 93, "EIGHT" 94, "BELL" 95, "WATER MELON" 96, "PLUM" 97, "ORANGE" 98, "CHERRY" 99, "BLANK" 100, and "BONUS SYMBOL" 101 (see FIGS. 3, 12, and 13). These eleven types of symbols will be collectively referred to as "symbols" 90.

On the video reels in the first reel display area 31 to the ninth reel display area 39, the above-described eleven types of symbols are disposed in different manners.

For each symbol serving as the video reel, a code number is defined. Accordingly, in the symbol determination process (S12) and the symbol display process (S13), operations for determination of a symbol and display of the symbol are controlled on the basis of a code number defined for the symbol.

As described above, in the slot machine 1 according to the embodiment, symbols are variably displayed and one symbol is stopped to be displayed in each one of the first reel display area 31 to the ninth reel display area 39. In other words, the first reel display area 31 to the ninth reel display area 39 respectively include one symbol display area.

In addition, in each one of the first reel display area 31 to the ninth reel display area 39, a reel bet display section 18 is formed. This reel bet display section 18 represents the amount of the game value (that is, the number of bets) betted for a corresponding reel display area.

As shown in FIG. 3, in the slot machine 1 according to the embodiment, three pay lines including a first pay line 82 to a third pay line 84 are defined. The first pay line 82 is formed by the first reel display area 31, the fourth reel display area 34, and the seventh reel display area 37. In addition, the second pay line 83 is formed by the second reel display area 32, the fifth reel display area 35, and the eighth reel display area 38. In addition, the third pay line 84 is formed by the third reel display area 33, the sixth reel display area 36, and the ninth reel display area 39.

To the left side of the first reel display area 31 to the ninth reel display area 39, viewed from the front side, line bet display sections 19 are formed in correspondence with the first pay line 82 to the third pay line 84. Each line bet display section 19 displays the number of bets placed for the corresponding pay line.

In addition, on the lower right side of the lower image display panel 6, viewed from the front side, the credit display section 8 and the payout display section 9 are displayed. Here, in the credit display section 8, the number of credits currently owned by the player is displayed. In the payout display section 9, awards given in one game (that is, awards on the basis of the contents of the first and second prizes) are represented as the number of payouts.

On the front side of the lower image display panel 6, a touch panel 25 is disposed. The touch panel 25 serves as an operation unit for inputting a control operation in accordance with a portion of the touch panel 25 touched by the player.

In the embodiment, the touch panel 25 detects a touch operation by the player to the reel bet display sections 18 associated with the first reel display area 31 to the ninth reel display area 39. Accordingly, the touch panel 25 serves as an operation unit for selecting a reel display area to be betted at a time when a bet is placed for each reel display area.

Similarly, the touch panel 25 detects a touch operation by the player to the line bet display sections 19 corresponding to the first pay line 82 to the third pay line 84. In other words, the touch panel 25 serves as operation unit for selecting a pay line to be betted at a time when a bet is placed for each pay line.

To the lower side of the lower image display panel 6, a control panel 20, a coin insertion slot 21, and a bill validator 22 are disposed.

On the control panel 20, a plurality of buttons to which directions made by the player for advancing the game is disposed. In particular, on the control panel 20, a SPIN button 13, a CHANGE button 14, a CASHOUT button 15, a 1-BET button 16, and a MAX-BET button 17 are disposed.

The SPIN button 13 serves an operation unit used for inputting a direction for starting a variable display process in each reel display area. The CHANGE button 14 serves an operation unit used for requesting exchange of money to a clerk of a game arcade. The CASHOUT button 15 serves an operation unit for inputting a direction for paying out coins (one credit corresponds to one coin) corresponding to the number of credits owned by the player from the coin payout opening 23 into a coin tray 24.

The 1-BET button 16 serves an operation unit used for inputting a direction for betting one credit from among credits owned by the player in a bet area (that is, a reel display area or a pay line). The MAX-BET button 17 serves an operation unit used for inputting a direction for betting credits corresponding to a maximum number of credits to be betted on the bet area from among credits owned by the player, in a game.

Figure 4:
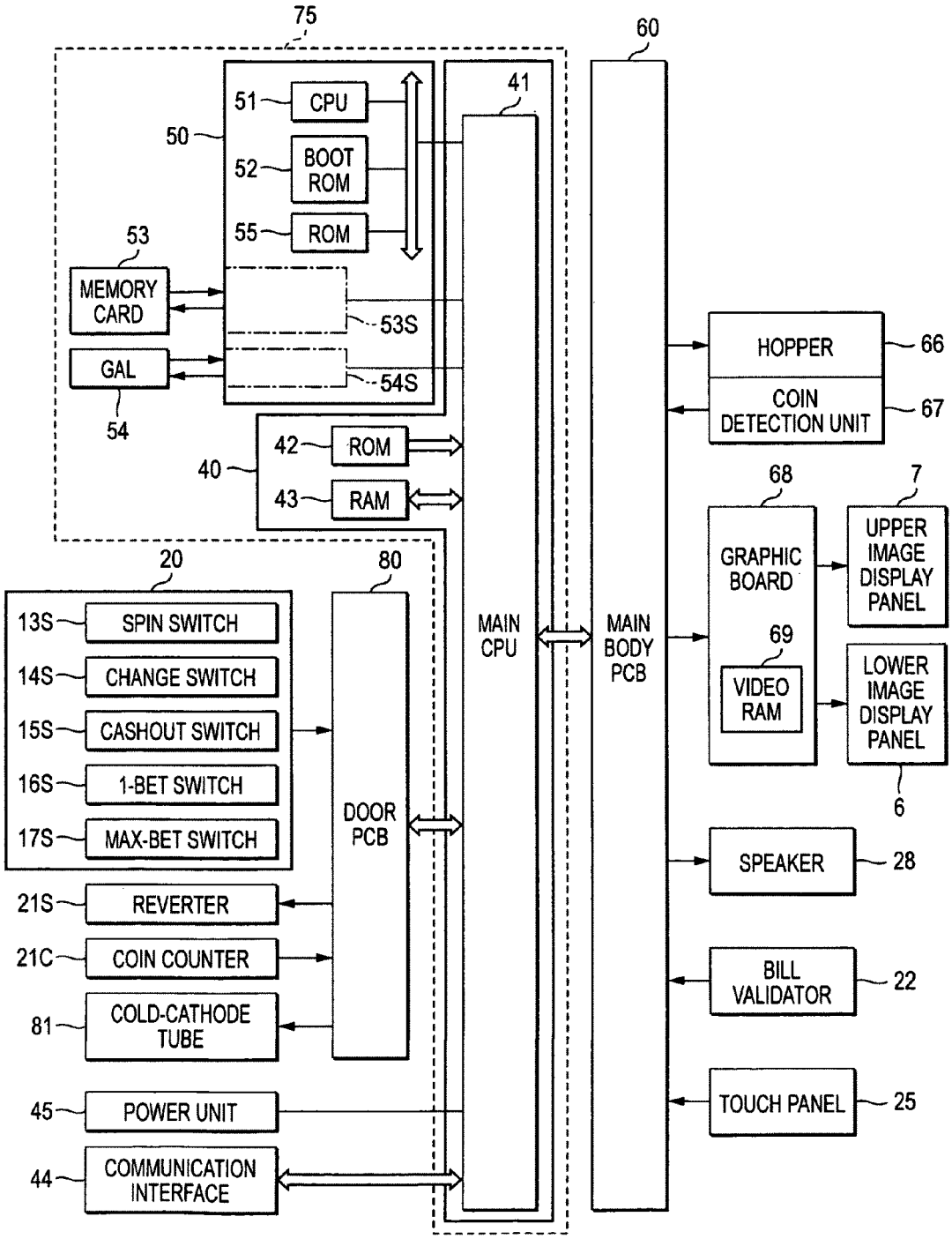
FIG. 4 is a block diagram showing a control system of the slot machine.

Inside the coin insertion slot 21, a reverter 21S and a coin counter 21C are disposed (see FIG. 4). The validity of a coin inserted into the coin insertion slot 21 is checked by the reverter 21S. At this moment, a coin other than a normal coin is discharged from the coin payout opening 23. On the other hand, inserted coins that have been checked as normal coins are detected by the coin counter 21C and the number of the coins is counted.

The bill validator 22 checks the validity of a bill and accepts a normal bill into the cabinet 2.

For a slot machine 1 according to the embodiment, a coin, a bill, or electronic valuable information (credit) corresponding thereto is used as a game media. However, a game media that can be used in an embodiment of the present invention is not limited thereto, and, for example, a medal, a token, electronic money, a ticket, or the like can be used.

Next, a control system of the slot machine 1 according to the embodiment will be described with reference to the accompanying drawings. FIG. 4 is a schematic block diagram showing the control system of the slot machine 1 according to the embodiment.

As shown in FIG. 4, the control system of the slot machine 1 is basically constituted by a mother board 40 and a gaming board 50. In other words, a game controller 75 of the slot machine 1 is configured by the mother board 40 and the gaming board 50.

At first, the gaming board 50 will be described. The gaming board 50 includes a CPU 51, a ROM 55, and a boot ROM 52 which are connected with one another through an internal bus, a card slot 53S corresponding to a memory card 53 and an IC socket 54S corresponding to a GAL (Generic Array Logic) 54.

The memory card 53 is configured as a non-volatile memory and is a recording medium on which game programs and a game system program (hereinafter, referred to as game programs and the like) are recorded. A lottery program is included in the game programs recorded in the memory card 53.

This lottery program is basically used for determining symbols (code numbers corresponding to the symbols)

stopped to be displayed in the reel display areas. In addition, the lottery program is also executed in processes other than the symbol determination process.

The card slot 53S is configured such that the memory card 53 can be inserted into the card slot. The card slot is connected to the motherboard 40 through an IDE bus. Accordingly, the type or contents of the game performed by the slot machine 1 can be changed by rewriting the game program and the like that are stored in the memory card 53. In the game program, programs relating to the progress of the game and various types of data such as image data or sound data that is output during the game are included.

The GAL 54 is a type of a PLD having an OR fixed-type array structure. The GAL 54 includes a plurality of input ports and a plurality of output ports. When predetermined data is input to an input port, the GAL 54 outputs data corresponding to the input data from an output port thereof.

The IC socket 54S is configured such that the GAL 54 can be attached thereto. The IC socket 54S is connected to the mother board 40 through a PCI bus. Accordingly, output data output from the GAL 54 can be changed by rewriting the GAL 54 or replacing the GAL 54.

The CPU 51, the ROM 55, and the boot ROM 52 which are connected with one another through the internal bus is connected to the mother board 40 through a PCI bus. The PCI bus transmits signals between the mother board 40 and the gaming board 50 and supplies power to the gaming board 50 from the mother board 40. In the ROM 55, country identification information and an authentication program are stored. In the boot ROM 52, a preliminary authentication program, a program (boot code) for the CPU's 51 starting the preliminary authentication program, and the like are stored.

The authentication program is a program (a falsification checking program) for authenticating a game program and the like. The authentication program is described in an order of a falsification checking process for a game program and the like for which an authentication input process is to be performed. The preliminary authentication program is used for authenticating the above-described authentication program and is described in an order of a falsification checking process for an authentication program for which an authentication process is to be performed.

The motherboard 40 will now be described. The mother board 40 is configured by using a general-purpose mother board (a printed circuit board on which basic components of a personal computer are mounted) on the market. The mother board includes a main CPU 41, a ROM 42, a RAM 43, and a communication interface 44.

The ROM 42 is configured to include a memory device such as a flash memory. In the ROM 42, permanent data such as a program including a BIOS executed by the main CPU 41 and a lottery table used for a game is stored.

In the RAM 43, data and a program which are used for the operation of the main CPU 41 are stored. In addition, the RAM 43 can store various programs such as an authentication program and a game program and various types of information such as the current number of credits owned by a player.

The communication interface 44 serves as a communication device for communicating with a server, which is installed in the game arcade through a communication line, and the like. Accordingly, the slot machine 1 can communicate with the server or the like through the communication interface 44 for acquiring game information of the slot machine 1 and the like.

A main body PCB 60 and a door PCB 80 which will be descried later are connected to the mother board 40 through USBs. In addition, a power unit 45 is connected to the mother board 40. When power is supplied from the power unit 45 to the mother board 40, the operation of the main CPU 41 of the mother board 40 is started. In addition, power is supplied to the gaming board 50 through the PCI bus, whereby the operation of the CPU 51 is started.

To the main body PCB 60 and the door PCB 80, a device or an apparatus that generates an input signal for the main CPU 41 and a device or an apparatus of which operations are controlled in accordance with control signals transmitted from the main CPU 41 are connected. The main CPU 41 executes a game program and the like stored in the RAM 43 on the basis of the input signal. In addition, the main CPU 41 performs a predetermined calculation process and the like and performs a control process for each device or apparatus, in accompaniment with execution of the game program and the like.

To the main body PCB 60, a hopper 66, a coin detection unit 67, a graphic board 68, a speaker 28, a bill validator 22, and a touch panel 25 are connected.

The hopper 66 is disposed inside the cabinet 2 and pays out a predetermined number of coins from the coin payout opening 23 into the coin tray 24 on the basis of a control signal transmitted from the main CPU 41. The coin detection unit 67 is disposed inside the coin payout opening 23 and detects payment of coins of a predetermined number from the coin payout opening 23.

The graphic board 68 controls image display of the upper image display panel 7 and the lower image display panel 6 on the basis of a control signal transmitted from the main CPU 41. For example, the reel display areas are displayed on the lower image display panel 6 during a game. The graphic board 68 variably displays symbols serving as the video reels and stops symbols to be displayed in the reel display areas on the basis of an operation signal transmitted from the SPIN switch 13S.

In addition, the graphic board 68 performs display operations in the credit display section 8, the payout display section 9, the reel bet display section 18, and the line bet display section 19. In addition, the graphic board 68 performs a display control operation for the upper image display panel 7.

Here, the graphic board 68 includes a VDP (Video Display Processor) that generates image data on the basis of a control signal transmitted from the main CPU 41, a video RAM 69 that temporarily stores the image data generated by the VDP, and the like.

The bill validator 22 checks the validity of a bill and accepts a normal bill into the cabinet 2. When a normal bill is accepted, the bill validator 22 outputs a signal to the main CPU 41 on the basis of the amount of the bill.

The touch panel 25 serves as operation unit used for selecting a reel display area or a pay line as a bet area. As shown in FIG. 4, the touch panel 25 is connected to the main CPU 41 through the main body PCB 60, and when the touch panel 25 detects an operation of pressing the reel bet display section 18 or the line bet display section 19, the touch panel 25 outputs an operation signal to the main CPU 41. Accordingly, the main CPU 41 can determine a reel display area or a pay line for which a bet operation is performed on the basis of the operation signal.

To the door PCB 80, the control panel 20, the reverter 21S, the coin counter 21C, and a cold-cathode tube 81 are connected. On the control panel 20, a SPIN switch 13S, a CHANGE switch 14S, a CASHOUT switch 15S, a 1-BET switch 16S, and a MAX-BET switch 17S are provided. The SPIN switch 13S corresponds to the SPIN button 13. The CHANGE switch 14S corresponds to the CHANGE button 14. The CASHOUT switch 15S corresponds to the CASH- OUT button 15. The 1-BET switch 16S corresponds to the 1-BET button 16. The MAX-BET switch 17S corresponds to the MAX-BET button 17.

When a corresponding button is operated by the player, each one of the above-described switches outputs an input signal to the main CPU 41.

The coin counter 21C is disposed inside the coin insertion slot 21. When a coin is inserted into the coin insertion slot 21 by the player, the coin counter 21C checks the validity of the inserted coin. Accordingly, coins other than normal coins are discharged from the coin payout opening 23, and when a normal coin is detected, the coin counter 21C outputs an input signal to the main CPU 41.

The reverter 21S distributes coins that have been recognized as normal coins into a cash box (not shown) or the hopper 66 which are installed inside the slot machine 1. The cold-cathode tube 81 is installed on the rear side of the lower image display panel 6 and the upper image display panel 7. The cold-cathode tube 81 serves as back light for the lower image display panel 6 and the upper image display panel 7.

Figure 5:
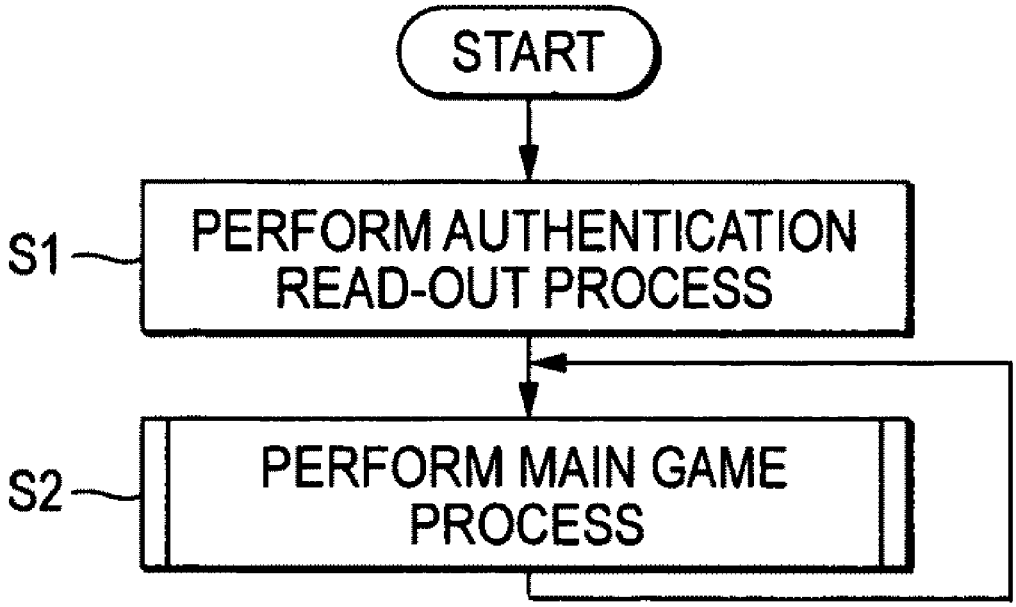
FIG. 5 is a flowchart of a main control processing program according to the embodiment.

Subsequently, a main control program that is executed in the slot machine 1 according to the embodiment will be described in detail with reference to the accompanying drawings. FIG. 5 is a flowchart of the main control program.

In the slot machine 1, it is assumed that the memory card 53 is inserted into the card slot 53S of the gaming board 50 and the GAL 54 is attached to the IC socket 54S.

At first, when a power switch of the power unit 45 is turned on (power is input), the operations of the mother board 40 and the gaming board 50 are started in the slot machine 1, whereby an authentication read-out process (S1) is performed. In the authentication read-out process, the mother board 40 and the gaming board 50 perform independent processes in parallel.

In other words, the CPU 51 of the gaming board 50 reads out a preliminary authentication program from the boot ROM 52 and performs a preliminary authentication process. This preliminary authentication process checks and verifies that the authentication program has not been falsified in advance before being inputted to the mother board 40.

In the mother board 40, the main CPU 41 executes the BIOS and expands compressed data stored in the BIOS into the RAM 43. Then, the main CPU 41 performs execution of the BIOS expanded into the RAM 43 and performs diagnosis and initialization processes for various peripheral devices.

Thereafter, the main CPU 41 reads out an authentication program from the ROM 55 and performs an authentication process of a game program. The authentication process of the game program checks and verifies that a game program or the like stored in the memory card 53 has not been falsified. When this authentication process is completed normally, the main CPU 41 stores the game program and the like that have been authenticated in the RAM 43 and acquires the payout rate setting data and the country identification information. After the above-described processes are performed, the main CPU 41 completes the authentication read-out process.

In Step S2, the main CPU 41 sequentially reads out and executes the game program and the like, which have been authenticated in the authentication read-out process (S1), from the RAM 43 and performs a main game process. By performing the main game process, a game is performed in the slot machine 1 according to the embodiment. The main game process is repeatedly performed while power is supplied to the slot machine 1.

Figure 6:
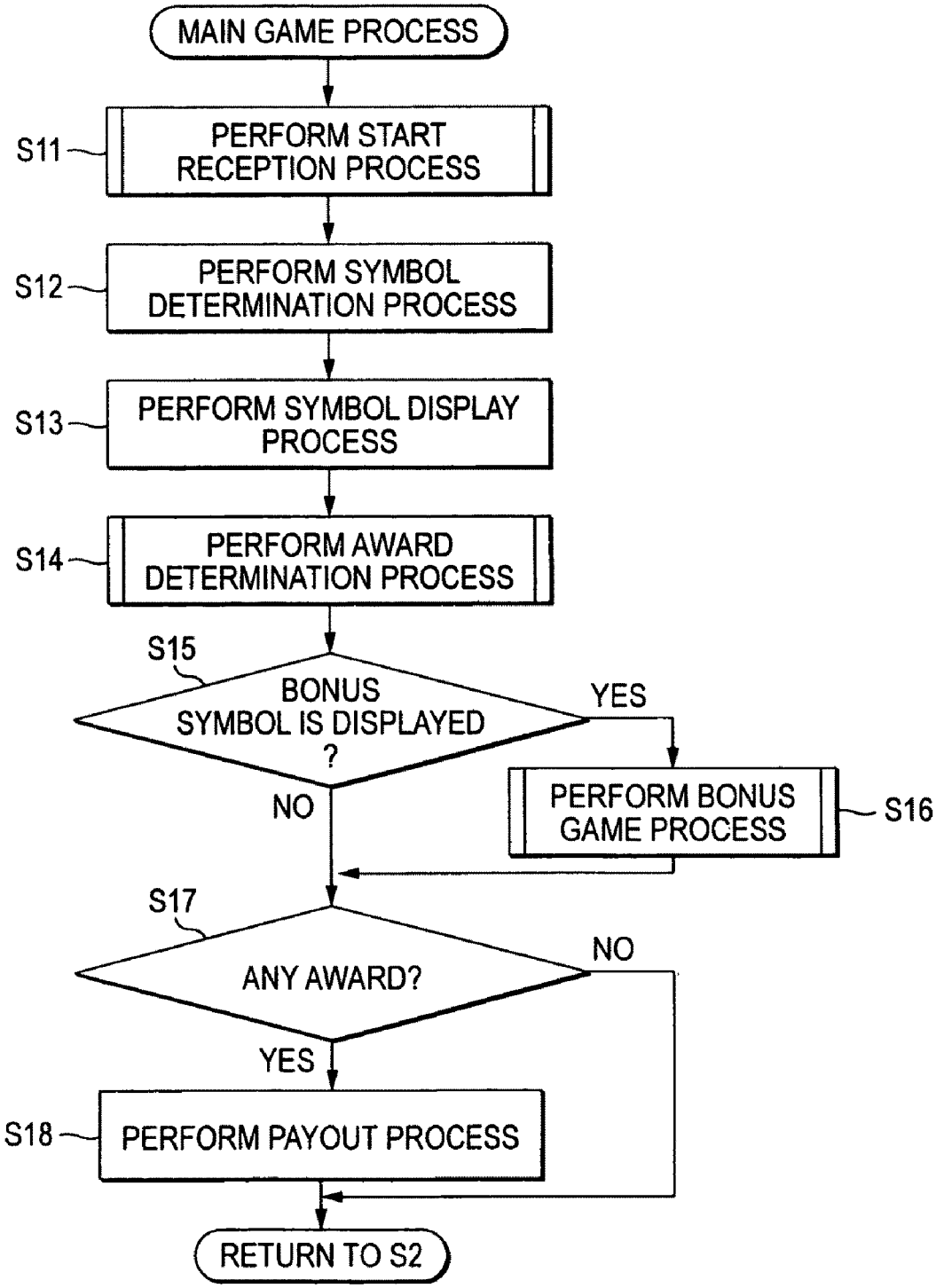
FIG. 6 is a flowchart of a main game processing program according to the embodiment of the present.

Next, the main game processing program of the slot machine 1 according to the embodiment will be described with reference to the accompanying drawings. FIG. 6 is a flowchart of the main game processing program of the slot machine 1.

As shown in FIG. 6, the main CPU 41, first, performs a predetermined initialization process, and then performs a start reception process (S11). In the initialization process, a process including a process of clearing data (for example, a payout counter and the like) of items set in predetermined data areas and the like are performed.

In the start reception process (S11), the main CPU 41 performs a process of setting the number of bets for each reel display area (the first reel display area 31 to the ninth reel display area 39) or each pay line (the first pay line 82 to the third pay line 84) on the basis of the operation of the 1-BET button 16, the MAX-BET button 17, and the touch panel 25 which is performed by the player. After completing the start reception process (S11), the main CPU 41 proceeds to the process of Step S12.

The start reception process (S11) will be described in detail later.

When the control proceeds to Step S12, the main CPU 41 performs a symbol determining process. In particular, in the symbol determining process (S12), the main CPU 41 samples a random number by executing a lottery program and determines symbols stopped to be displayed in the reel display areas on the basis of the random number and the video reels for the reel display areas. Since the symbol determining process has been known in public, a description thereof in detail is omitted here.

After determining the symbols stopped to be displayed in the reel display areas, the main CPU 41 proceeds to a symbol display process (S13).

When the control proceeds to the symbol display process (S13), the main CPU 41 variably displays symbols in the reel display areas in accordance with the video reels. When a predetermined period elapses after the variable symbol display is started, the main CPU 41 stops symbols, which have been determined in the symbol determination process (S12), to be displayed in the reel display areas. Since the processes of variably displaying symbols and stopping symbols to be displayed have been known in public, a detailed description thereof is omitted here.

After the symbols are stopped to be displayed, the main CPU 41 completes the symbol display process (S13) and proceeds to the process of Step S14.

In Step S14, the main CPU 41 performs an award determination process. In this award determination process (S14), the main CPU 41 determines contents of prizes to be given to the player on the basis of the symbols stopped to be displayed in the reel display areas for which a bet is placed. In particular, the main CPU 41 determines the content of a first award and the content of a second award, and determines the prizes as prizes to be given to the player. The content of the first award is determined as the content of the award when a bet is placed for a pay line and a combination of the symbols stopped to be displayed in the reel display areas serving as the betted pay line corresponds to a predetermined winning combination. In addition, the content of the second award is determined on the basis of the symbols stopped to be displayed in the reel display areas corresponding to the award determining area and the number of bets placed in the reel display areas.

After determining the prizes to be given to the player by performing the award determination process for the contents of the first and second prizes, the main CPU 41 proceeds to the process of Step S15. Hereinafter, a game performed on the basis of the processes of Steps S11 to S14 of the main game process is referred to as a "base game".

The award determination process (S14) also will be described in detail later with reference to the accompanying drawings.

When proceeding to Step S15, the main CPU 41 determines whether a bonus symbol 101 is stopped to be displayed in a reel display area corresponding to the award determining area on the basis of the result of the determination made in the award determination process (S14). When the bonus symbol 101 is stopped to be displayed (S15: YES), the main CPU 41 proceeds to a bonus game process (S16). On the other hand, when the bonus symbol 101 is not stopped to be displayed in a reel display area corresponding to the award determining area (S15: NO), the main CPU 41 proceeds to Step S17.

When proceeding to Step S16, the main CPU 41 performs the bonus game process. In this bonus game process (S16), the main CPU 41 sets a free game in the bet area (that is, a reel display area or a pay line) in which the bonus symbol 101 has been stopped to be displayed. In other words, the main CPU 41 determines the bet area in which the bonus symbol 101 has been stopped to be displayed as a bonus area. Then, the main CPU 41 sets the number of bets placed for the bonus area in a game in which the bonus symbol 101 has been stopped to be displayed as the number of bets for the bet area. In such a case, a game value owned by the player is not consumed at all. This free game is performed for a predetermined number of times (in the embodiment, five times). In addition, in the bonus game process (S16), the main CPU 41 accepts a bet of a game value for each bet area other than the bonus area.

Since this bonus game process (S16) will be described later in detail with reference to the accompanying drawings, a detailed description thereof is omitted here.

When the bonus game process (S16) is completed by performing the free game for the predetermined number of times, the main CPU 41 proceeds to the process of Step S17.

When proceeding to Step S17, the main CPU 41 determines whether there is an award (that is, an award to be given to the player) with reference to the RAM 43. In this award, an award determined in the award determination process (S14) and an award determined in the bonus game process (S16) are included. When there is an award (S17: YES), the main CPU 41 proceeds to a payout process (S18). Then, in the payout process (S18), the main CPU 41 gives the player an award on the basis of the result of determination in the award determination processes (S14 and S45). In that case, the award may be added to the credits, or coins corresponding to the award may be paid out. When the payout of the award is completed, the main CPU 41 completes the main game processing program.

On the other hand, when the amount of the award on the basis of the result of the determination in the award determination processes (S14 and S45) is "0" (S17: NO), the main CPU 41 completes the main game processing program immediately.

When the main game processing program is completed, the main CPU 41 performs the main game process (S2) again on the basis of the main control program (see FIG. 5). In other words, in the slot machine 1, in order to start a new game after the main game processing program is completed, the main game processing program is executed again.

Figure 7:
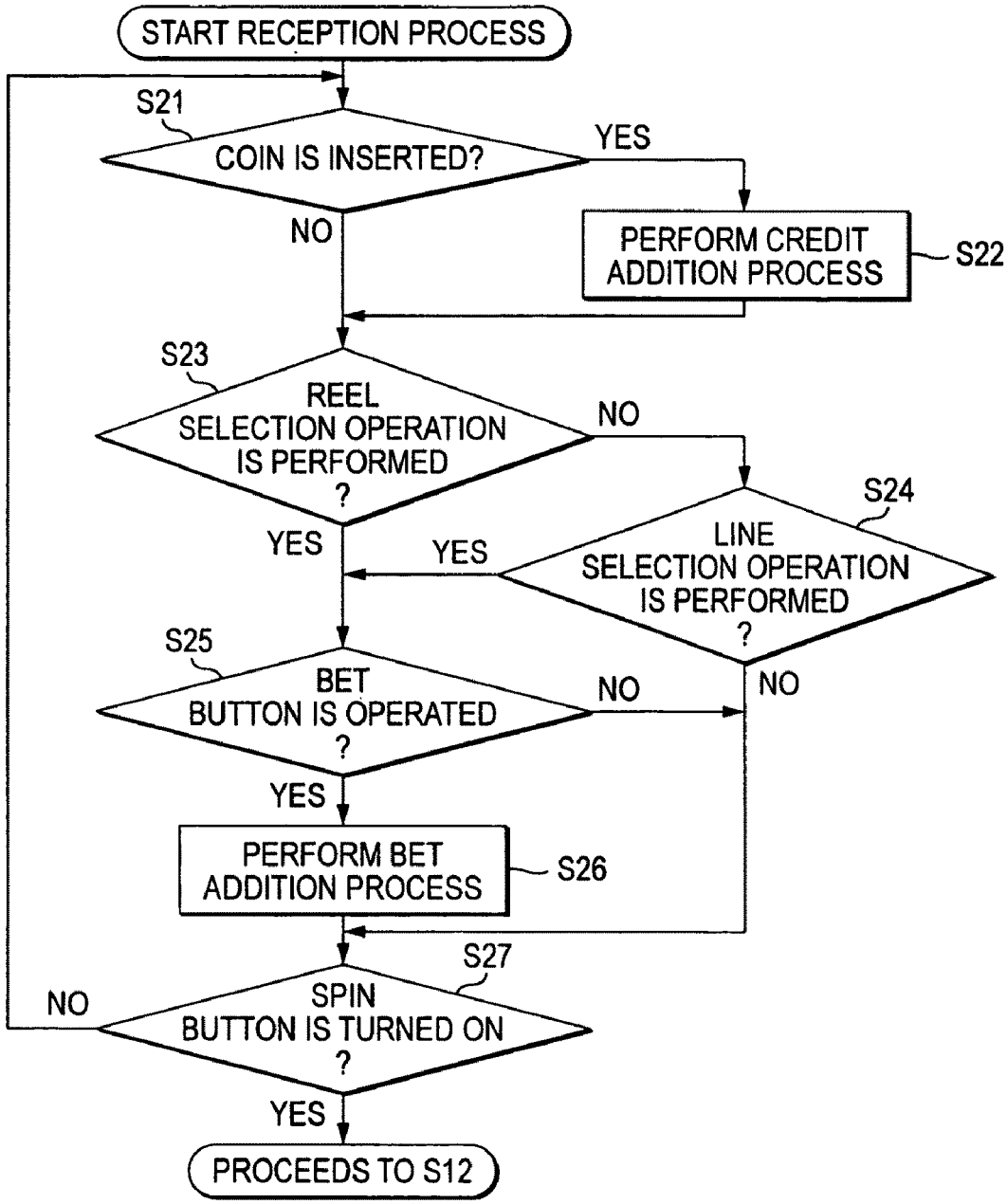
FIG. 7 is a flowchart of a start reception processing program according to the embodiment.

Subsequently, the start reception processing program executed in Step S11 of the main game process will be described in detail with reference to the accompanying drawings. FIG. 7 is a flowchart of the start reception processing program.

When proceeding to the start reception process (S11), the main CPU 41 determines whether a coin or the like (that is, a coin or a bill) has been inserted (S21). In particular, the main CPU 41 performs a determination process of Step S21 on the basis of a signal transmitted from the coin counter 21C.

When the coin or the like is inserted (S21: YES), the main CPU 41 performs a credit addition process (S22). In the credit addition process (S22), the main CPU 41 adds credits corresponding to the inserted coin to the current credits on the basis of a signal transmitted from the coin counter 21C. After the credits corresponding to the inserted coin are added, the main CPU 41 proceeds to the process of S23. On the other hand, when any coin is not inserted (S21: NO), the main CPU 41 proceeds to the process of Step S23 immediately.

When proceeding to the process of Step S23, the main CPU 41 determines whether a reel selection operation is performed. Here, the reel selection operation is for selecting a bet area, from among the first reel display area 31 to the ninth reel display area 39, for which a game value is betted. In particular, in the embodiment, the reel selection operation is performed by pressing a touch panel 25 corresponding to the reel bet display section 18.

When the reel selection operation is performed (S23: YES), the main CPU 41 determines the selected reel display area on the basis of an operation signal transmitted from the touch panel 25 and stores data representing the reel display area in the RAM 43. Then, the main CPU 41 proceeds to the process of Step S25. On the other hand, when the reel selection operation is not performed (S23: NO), the main CPU 41 proceeds to the process of Step S24.

When proceeding to S24, the main CPU 41 determines whether a line selection operation is performed. Here, the line selection operation is for selecting a bet area, from among the first pay line 82 to the third pay line 84, for which a game value is betted. In particular, in the embodiment, the line selection operation is performed by pressing a touch panel 25 corresponding to the line bet display section 19. When the line selection operation is performed (S24: YES), the main CPU 41 determines the selected pay line on the basis of an operation signal transmitted from the touch panel 25 and stores data representing the pay line in the RAM 43. Then, the main CPU 41 proceeds to the process of Step S25. On the other hand, when the line selection operation is not performed (S24: NO), the main CPU 41 proceeds to the process of Step S27.

In the process of Step S25 to which the control proceeds in a case where the reel selection operation or the line selection operation is performed, the main CPU 41 determines whether the 1-BET button 16 or the MAX-BET button 17 is operated. In particular, the main CPU 41 performs the determination process of Step S25 on the basis of a signal transmitted form the 1-BET switch 16S or the MAX-BET switch 17S.

When the operation of the 1-BET button 16 or the like is performed (S25: YES), the main CPU 41 proceeds to the bet addition process (S26). On the other hand, when the operation of the 1-BET button 16 or the like is not performed (S25: NO), the main CPU 41 proceeds to the process of Step S27.

In the bet addition process (S26), the main CPU 41 adds a game value corresponding to the operation of the 1-BET button 16 or the MAX-BET button 17 to the number of bets for the reel display area or the pay line which has been selected as the bet area.

In other words, when the 1-BET button 16 is operated, the main CPU 41 adds one to the current number of bets for the selected bet area. On the other hand, when the MAX-BET button 17 is operated, the main CPU 41 sets a maximum number of bets for the bet area as the number of bets.

After storing the number of bets for the bet area, for which the addition process has been performed, in the RAM 43, the main CPU 41 proceeds to the process of Step S27.

When proceeding to Step S27, the main CPU 41 determines whether the SPIN button 13 is operated. In particular, the main CPU 41 performs a determination process of Step S27 on the basis of reception of an operation signal transmitted from the SPIN switch 13S. When the SPIN button 13 is operated (S27: YES), the main CPU 41 determines the numbers of bets for each reel display area and each pay line and completes the start reception processing program. In other words, the main CPU 41 determines the numbers of bets for each bet area in the current game on the basis of the operation of the SPIN button 13 and determines bet areas for which the numbers of bets are set as the award determination areas. When completing the start reception processing program, the main CPU 41 proceeds to the symbol determination process (S12) of the main game processing program.

On the other hand, when the SPIN button 13 is not operated (S27: NO), the main CPU 41 proceeds back to the process of Step S21. Accordingly, the player can add or change the bet of a game value for the reel display areas or the pay lines.

Figure 8:
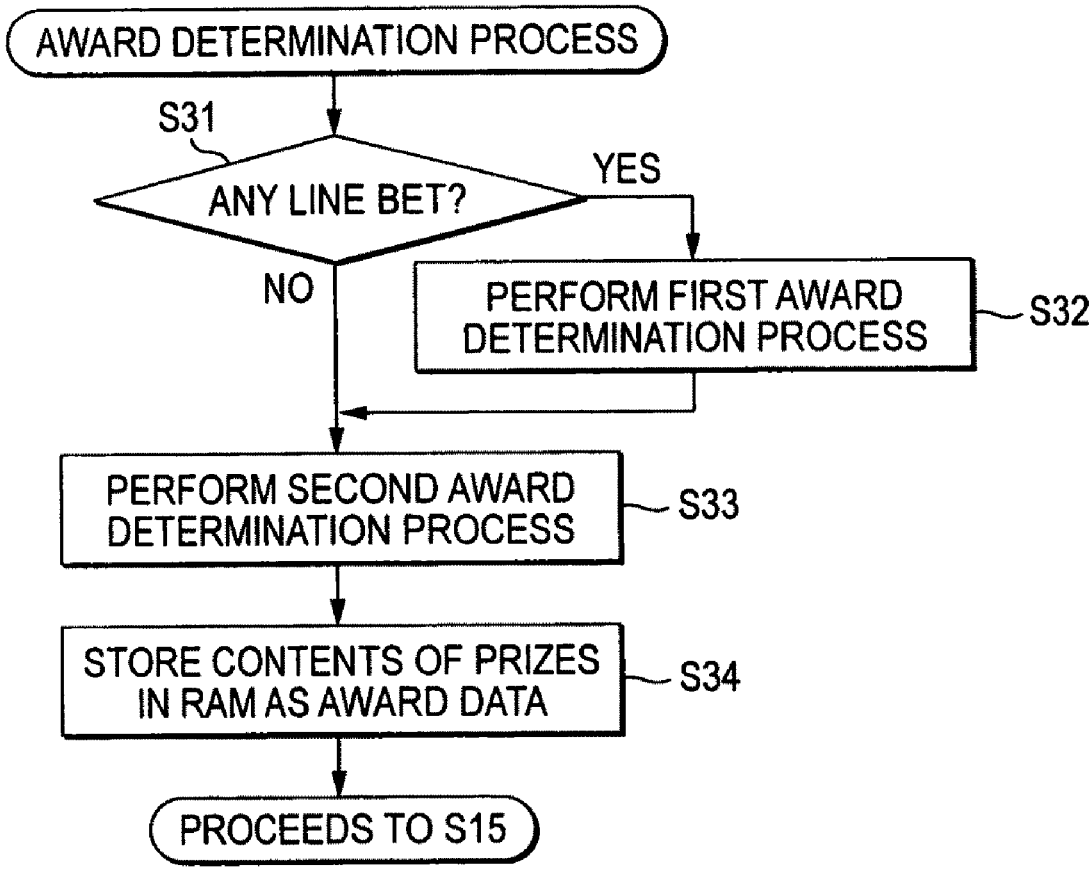
FIG. 8 is a flowchart of an award determination processing program according to the embodiment.

Subsequently, the award determination processing program executed in Step S14 of the main game processing program will be described in detail with reference to the accompanying drawings. FIG. 8 is a flowchart of the award determination processing program.

After variably displaying symbols and stopping symbols to be displayed in the reel display areas by performing the symbol determination process (S12) and the symbol display process (S13), the main CPU 41 executes an award determination processing program.

When execution of the award determination processing program is started, the main CPU 41 determines whether a line bet is placed in the current game. In other words, the main CPU 41 determines whether a pay line is included in the award determination area for the current game (S31). In particular, the main CPU 41 performs the determination process of Step S31 on the basis of the numbers of bets for each pay line, with reference to the numbers of bets for the award determination areas which are stored in the RAM 43. When the line bet is placed (S31: YES), the main CPU 41 proceeds to a first award determination process (S32). On the other hand, when the line bet is not placed (S31: NO), the main CPU 41 proceeds to a second award determination process (S33).

When proceeding to the first award determination process (S32), the main CPU 41 refers to symbols stopped to be displayed in the reel display areas serving as the pay line (one of the first pay line 82 to the third pay line 84) set as the award determination area. Then, the main CPU 41 determines whether the combination of symbols on the pay line corresponds to a predetermined winning combination (see FIG. 9). When the winning combination is achieved on the pay line set as the award determination area, the main CPU 41 determines the content of the first award on the basis of the award (see FIG. 9) defined for the winning combination and stores the content of the first award in the RAM 43. On the other hand, when the winning combination is not achieved, the main CPU 41 determines the content of the first award for the pay line to be "0". In addition, in such a case, when the bonus symbol 101 is stopped to be displayed in a reel display area serving as the pay line, any winning combination is not achieved, and therefore the content of the first award becomes "0".

After the contents of the first prizes for all the pay lines set as the award determination areas in the current game are determined, the main CPU 41 proceeds to the second award determination process (S33).

When proceeding to S33, the main CPU 41 performs the second award determination process.

The second award determination process (S33) determines the content of the second award on the basis of the symbols stopped to be displayed in the reel display areas serving as the award determination area, a second award determination table (see FIG. 10), and the number of bets placed for the reel display area.

In particular, when the award determination area is a reel display area, the main CPU 41 determines a symbol stopped to be displayed in the reel display area and acquires a multiplication factor for the symbol on the basis of the second award determination table (see FIG. 10). The main CPU 41 multiplies the number of bets for the reel display area by the acquired multiplication factor for determining the content of the second award for the reel display area.

On the other hand, when the award determination area is a pay line, a same process as in the above-described case where the award determination area is the reel display area is performed for each reel display area serving as the pay line. In such a case, the number of bets for the pay line is used as the number of bets for each reel display area serving as the pay line. The number of bets for each reel display area serving as the pay line may be set to be ⅓ times the number of bets for the pay line.

Here, when the bonus symbol 101 is stopped to be displayed in the reel display area serving as the award determination area, the main CPU 41 determines "a free game for the bet area" as the content of the second award and stores the content of the second award in the RAM 43.

In other words, when a display area is the award determination area, the main CPU 41 sets a free game for the reel display area. On the other hand, when the bonus symbol 101 is stopped to be displayed in the reel display area serving as a pay line in a case where the pay line is the award determination area, the main CPU 41 sets a free game for the pay line. When the bonus symbol 101 is stopped to be displayed in a reel display area in a case where a pay line and a reel display area serving as the pay line are set as the award determination areas, the main CPU 41 sets free games for the pay line and the reel display area in which the bonus symbol 101 is stopped to be displayed.

After determining the contents of the second prizes for all the award determination areas (the reel display areas and the pay line), the main CPU 41 sums the results of award determination processes of the second prizes for all the award determination areas together for determining the content of the second award in the current game. After determining the content of the second award in the current game and storing the content of the second award in the RAM 43, the main CPU 41 proceeds to the process of Step S34.

When proceeding to S34, the main CPU 41 stores the contents of the first award and the second award, which are stored in the RAM 43, in the RAM 43 as awards to be given to the player. In particular, the main CPU 41 acquires the award determination results of the first award determination process (S32) and the second award determination process (S33) with reference to the RAM 43. The main CPU 41 sums the acquired contents of the first and second prizes together and stores the result in the RAM 43 as award data.

After storing the award data on the basis of the contents of the first and second prizes in the RAM 43, the main CPU 41 completes the award determination processing program and proceeds to the process of Step S15 of the main game processing program.

Figure 11:
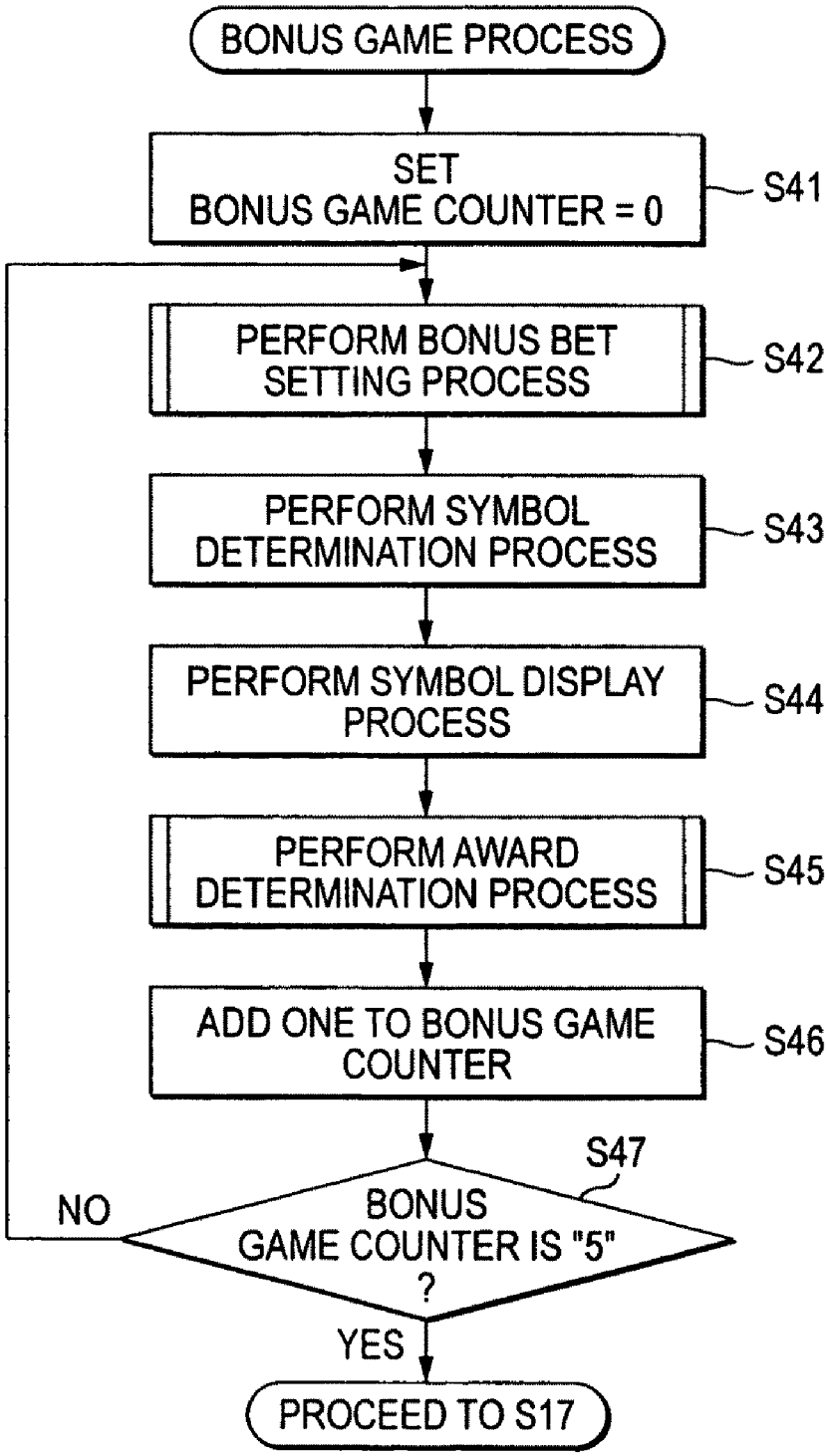
FIG. 11 is a flowchart of a bonus game processing program according to the embodiment.

Next, the bonus game processing program executed in Step S16 of the main game processing program will be described in detail with reference to the accompanying drawings. FIG. 11 is a flowchart of the bonus game processing program.

As described above, when the bonus symbol 101 is stopped to be displayed in the reel display area serving as the award determination area (S15: YES), the main CPU 41 executes the bonus game processing program.

As shown in FIG. 11, when the bonus game processing program is started, the main CPU 41, first, initializes a bonus game counter formed in the RAM 43 (S41). In other words, the main CPU 41 sets the value of the bonus game counter to be "0".

After setting the value of the bonus game counter as "0", the main CPU 41 proceeds to the process of Step S42.

When proceeding to S42, the main CPU 41 performs a bonus bet setting process. In the bonus bet setting process (S42), the main CPU 41 sets the number of bets for each bet area (each reel display area and each pay line) in the bonus game. In particular, the main CPU 41 sets a free game for the award determination area in which the bonus symbol 101 is stopped to be displayed. In other words, the main CPU 41 sets the number of bets for the award determination area at a time when the bonus symbol 101 has stopped as the number of bets for the bet area without consuming the game value (for example, credits) owned by the player. In the embodiment, the award determination area in which the bonus symbol 101 is stopped to be displayed will be referred to as a bonus area.

In addition, at this moment, the main CPU 41 accepts a bet of a game value for each bet area other than the bonus area.

After determining the number of bets for each bet area on the basis of an operation of the player, the main CPU 41 proceeds to the process of Step S43.

The bonus bet setting process (S42) will be described later in detail with reference to the accompanying drawings.

When proceeding to S43, the main CPU 41 determines a symbol determination process. The symbol determination process (S43) is the same as the symbol determination process (S12) of the main game processing program. In other words, the main CPU 41 determines symbols stopped to be displayed in the first reel display area 31 to the ninth reel display area 39 by executing a lottery program. After determining the symbols stopped to be displayed in each reel display area and storing the determined symbols in the RAM 43, the main CPU 41 proceeds to Step S44.

Since the symbol determination process (S12) that is the same process as the symbol determination process (S43) has been described as above, a detailed description thereof is omitted here.

When proceeding to Step S44, the main CPU 41 performs a symbol display process. This symbol display process (S44) is a process in which symbols are variably displayed in the reel display areas and then, after a predetermined time elapses, symbols determined in the symbol determination process (S43) are stopped to be displayed. After stopping the symbols determined in the symbol determination process (S43) to be displayed in the reel display areas, the main CPU 41 proceeds to the process of Step S45.

Since the symbol display process (S44) is the same as the symbol display process (S13) of the main game processing program, a detailed description thereof is omitted here.

In S45, the main CPU 41 performs an award determination process. This award determination process (S45) determines the contents of the first and second prizes on the basis of the symbols stopped to be displayed in the award determination area and the number of bets placed for the award area. In other words, the award determination process (S45) is basically the same as the award determination process (S14) of the main game processing program. Accordingly, a detailed description of the award determination process (S45) is omitted here.

After storing award data on the basis of the symbols stopped to be displayed in the award determination areas in the RAM 43 in Step S44, the main CPU 41 completes the award determination process (S45) and proceeds to the process of Step S46.

According to the embodiment, when the BONUS symbol 101 is stopped to be displayed in the award determination area in the bonus game process (S16), the bonus symbol 101 is treated as "BLUE 7" 91. In other words, during the bonus game, a wining combination defined by "BLUE 7" 91 in the first award determination table (see FIG. 9) can be achieved even in a case where "BLUE 7" 91 is replaced by the bonus symbol 101. In addition, in the second award determination of the bonus game process (S16), the bonus symbol 101 is treated as a multiplication factor of "×20" instead of "providing a bonus game".

After performing the award determination process (S45) in the bonus game, the main CPU 41 proceeds to the process of Step S46.

In the embodiment, although the bonus symbol 101 is configured to be treated as "BLUE 7" 91 in the bonus game process (S16), the bonus symbol may be configured to be treated as a bonus symbol 101, like in the award determination process (S14) of the main game process. In such a case, when the bonus symbol is 101 is stopped to be displayed in the award determination area, it may be configured that a predetermined number of times on the basis of the bonus symbol 101 is added to the current number of times of free games.

When proceeding to Step S46, the main CPU 41 adds one to the value of the bonus game counter formed in the RAM 43. After adding one to the bonus game counter, the main CPU 41 proceeds to Step S47.

In S47, the main CPU 41 determines whether the value of the bonus counter is "5". In other words, the main CPU 41 determines whether the free game as a bonus game is performed five times with reference to the RAM 43. When the value of the bonus game counter is "5" (S47: YES), the main CPU 41 completes the bonus game processing program and proceeds to the process of Step S17 of the main game processing program.

On the other hand, when the value of the bonus game counter is not "5" (S47: NO), the main CPU 41 proceeds back to the bonus bet setting process (S42). Accordingly, in the slot machine 1, the next game can be performed in the bonus game process (S16). In addition, since the control proceeds to the bonus bet setting process (S42), the player can set the number of bets for the bet area for the next free game.

Figure 1:
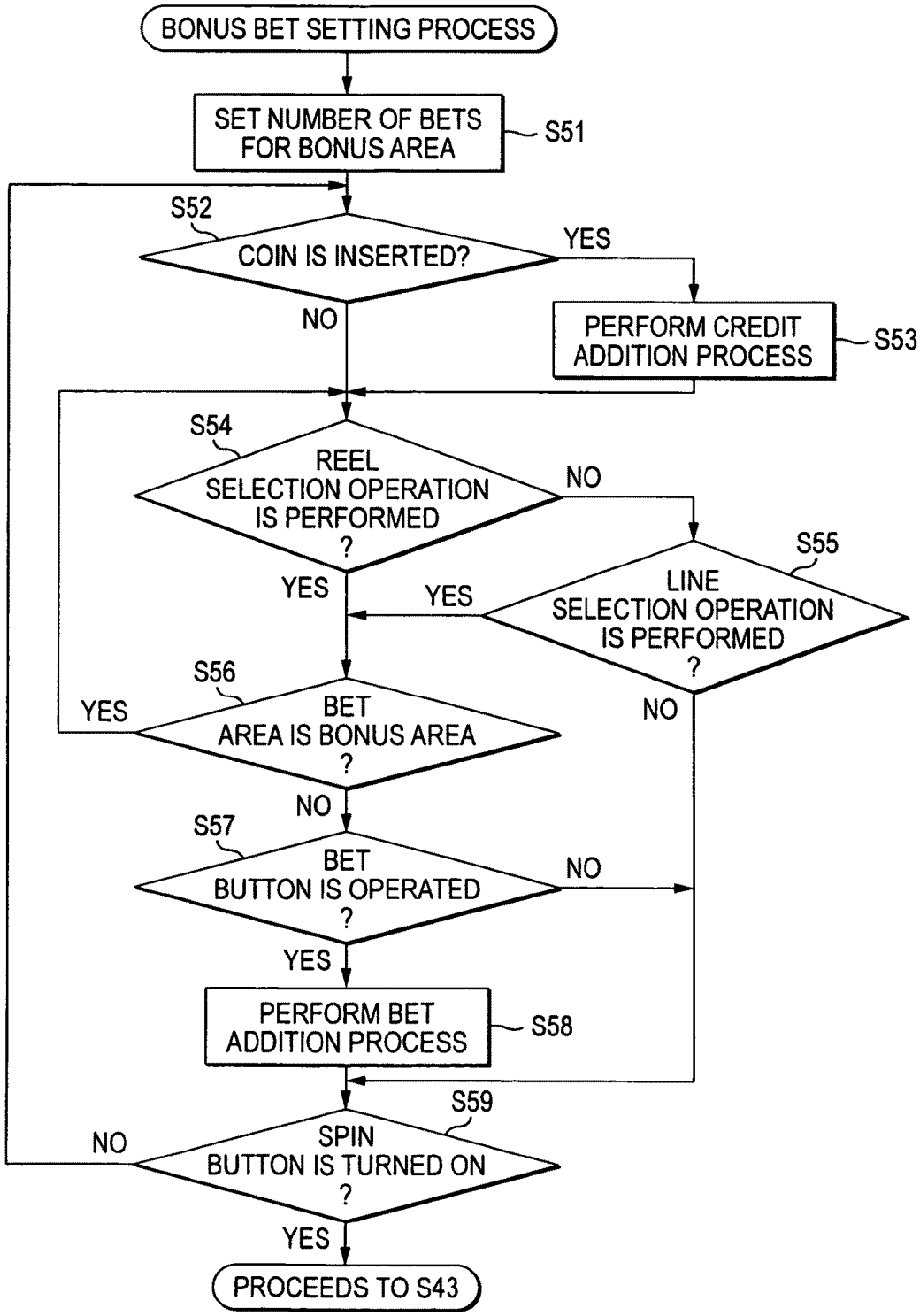
FIG. 1 is a flowchart of a bonus bet setting processing program according to an embodiment of the present invention.

Subsequently, the bonus bet setting processing program executed in Step S42 of the bonus game processing program will be described in detail with reference to the accompanying drawings. FIG. 1 is a flowchart of the bonus bet setting processing program.

When proceeding to the bonus bet setting process (S42), the main CPU 41, first, sets the number of bets for the bonus area. In particular, first, the main CPU 41 determines the award determination area (that is, the reel display area or the pay line in which a game value is betted) in which the bonus symbol 101 is stopped to be displayed as the bonus area with reference to the RAM 43. Then, the main CPU 41 sets the number of bets set at a time when the bonus symbol 101 is stopped to be displayed in the determined bet area as the number of bets for the bonus area. In this case, the main CPU 41 does not decrease the game value (for example, credits) owned by the player at all. Accordingly, a free game is set for the bonus area.

After storing the determined bonus area and the numbers of bets for the determined bonus area in the RAM 43, the main CPU 41 proceeds to the process of Step S52.

When proceeding to S52, the main CPU 41 determines whether a coin or the like has been inserted from the coin insertion slot 21 or the like. When the coin or the like has been inserted (S52: YES), the main CPU 41 performs a credit addition process (S53). After performing the credit addition process (S53), the main CPU 41 proceeds to Step S54. On the other hand, when the coin or the like has not been inserted (S42: NO), the main CPU 41 proceeds to Step S54. The processes of Steps S52 and S53 are the same as those of Steps S21 and S22 of the start reception processing program. Thus, a detailed description of Steps S52 and S53 is omitted here.

When proceeding to S54, the main CPU 41 determines whether a reel selection operation has been performed. When the reel selection operation has been performed (S54: YES), the main CPU 41 proceeds to the process of Step S56. On the other hand, when the reel selection operation has not been performed (S54: NO), the main CPU 41 proceeds to the process of Step S55.

In S55, the main CPU 41 determines whether a line selection operation has been performed. When the line selection operation has been performed (S55: YES), the main CPU 41 proceeds to the process of Step S56. On the other hand, when the line selection operation has not been performed (S55: NO), the main CPU 41 proceeds to the process of Step S59.

The determination processes of Steps S54 and S55 are the same as those of S23 and S24 of the start reception processing program. Thus, a detailed description of Steps S54 and S55 is omitted here.

In S56, the main CPU 41 determines whether the bet area selected by the reel selection operation or the line selection operation is the bonus area. In other words, the main CPU 41 determines whether a free game is set in the selected bet area with reference to the RAM 43. When the selected bet area is the bonus area (S56: YES), the main CPU 41 proceeds back to Step S54. Accordingly, when the bonus area is selected as the bet area, the selection operation is handled as an invalid operation. When the control proceeds back to S54 as described above, the main CPU 41 accepts selection operations for other reel display areas and pay lines. On the other hand, when the selected bet area is not the bonus area (S56: NO), the main CPU 41 proceeds to the process of Step S57.

When proceeding to S57, the main CPU 41 determines whether an operation of the 1-BET button 16 or the like has been performed. When the operation of the 1-BET button 16 or the like has been performed (S57: YES), the main CPU 41 proceeds to a bet addition process (S58). In the bet addition process (S58), the main CPU 41 sets the number of bets in the bet area on the basis of the bet operation. After setting the number of bets in the bet area on the basis of the bet operation, the main CPU 41 proceeds to the process of Step S59. On the other hand, when an operation of the 1-BET button 16 or the like has not been performed (S57: NO), the main CPU 41 proceeds to the process of Step S59. The processes of Steps S57 and S58 are the same as those of Steps S25 and S26 of the start reception processing program. Thus, a detailed description of Steps S57 and S58 is omitted here.

When proceeding to S59, the main CPU 41 determines whether the SPIN button 13 is operated. When the SPIN button 13 is operated (S59: YES), the main CPU 41 completes the bonus bet setting processing program and proceeds to the symbol determination process (S43) of the bonus game processing program. Accordingly, the numbers of bets for the bet areas in the current game (one game) are determined, and the award determination area for one free game is determined.

On the other hand, when the SPIN button 13 has not been operated (S59: NO), the main CPU 41 proceeds back to the process of Step S52. Accordingly, in the slot machine 1, the player can add a game value (for example, credits or the like) or add or modify the award determination area and the number of bets, for one bonus game.

Next, a slot game performed in the slot machine 1 according to the embodiment will be described in detail on the basis of detailed examples shown in FIGS. 12 and 13. FIG. 12 is a diagram showing a display form of the lower image display panel 6 at a time when a base game is completed.

As can be known from the numbers of bets displayed in the reel bet display section 18 and the line bet display section 19 which are shown in FIG. 12, in the start reception process (S11) of this example, the second reel display area 32, the third reel display area 33, the fourth reel display area 34, the fifth reel display area 35, the ninth reel display area 39, and the third pay line 84 are set as award determination areas.

The symbols stopped to be displayed in the reel display areas shown in FIG. 12 are determined by the symbol determination process (S12) on the basis of the player's operation of the SPIN button 13. Then, in the symbol display process (S13), symbols are variably displayed in each reel display area, and symbols are stopped to be displayed in the display form shown in FIG. 12.

Then, in the award determination process (S14), the contents of the first and second prizes for the case shown in FIG. 12 are determined and the contents are stored in the RAM 43 as award data.

Here, the first award determination process (S32) in the case will be described. As described above, in the case shown in FIG. 12, the pay line set as the award determination area is only the first pay line 82. In addition, the number of bets for the first pay line 82 is "3". Accordingly, in this case, the main CPU 41 performs a first award determination process only for the first pay line 82.

In the first reel display area 31, the fourth reel display area 34, and the seventh reel display area 37 which constitute the first pay line 82, "PLUM" 97, "BELL" 95, and "WATER MELON" 96 are stopped to be displayed. The main CPU 41 determines the content of the first award on the basis of the combination of the symbols and the first award determination table (see FIG. 9). In this case, the combination of "PLUM" 97, "BELL 95", and "WATER MELON" 96 does not correspond to any winning combination shown in FIG. 9. Accordingly, the content of the first award for the case shown in FIG. 12 becomes "0".

When the above-described first award determination process (S32) is completed, the main CPU 41 performs a second award determination process (S33). Next, the second award determination process (S33) for the case shown in FIG. 12 will be described in detail.

In this case, as shown in FIG. 12, for the second reel display area 32, the third reel display area 33, the fourth reel display area 34, the fifth reel display area 35, and the ninth reel display area 39, game values are betted. In other words, the reel display areas are set as award determination areas. In addition, in the case shown in FIG. 12, a game value is betted for the first pay line 82 as described above. In other words, the reel display areas (that is, the first reel display area 31, the fourth reel display area 34, and the seventh reel display area 37) serving as the first pay line 82 are also set as the award determination areas.

In the second award determination process (S33), the main CPU 41 determines the content of the second award on the basis of the symbols stopped to be displayed in the reel display areas corresponding to the above-described award determination areas and the numbers of bets for the reel display areas.

For example, in the case shown in FIG. 12, in the second reel display area 32, "RED 7" 92 is stopped to be displayed and "3" is set as the number of bets. In this case, the main CPU 41 looks up the second award determination table shown in FIG. 10. In the second award determination table, since a multiplication factor of "×20" is defined for "RED 7" 92, the content of the second award for the second reel display area 32 is determined to be "60". When the content of the second award is determined for each reel display area corresponding to the award determination area, as described above, the main CPU 41 stores the content of the second award in the RAM 43 as award data (S34), and proceeds to the process of Step S15.

In the case shown in FIG. 12, in the third reel display area 33 and the fifth reel display area 35 which are the award determination areas, the bonus symbols 101 are stopped to be displayed. As shown in the second award determination table (see FIG. 10), for the bonus symbol 101, "Award of a bonus game" is defined as the content of the second award. Accordingly, as the contents of the second prizes for the third reel display area 33 and the fifth reel display area 35, "Award of a free game" as a bonus game is determined.

In the case shown in FIG. 12, when the Bonus symbol 101 is stopped to be displayed in one of the reel display areas serving as the pay line (for example, the first pay line 82) that is the award determination area, a free game is set for the pay line (that is, the first pay line 82).

After performing the award determination process (S14), the main CPU 41 performs a determination process of Step S15. In the case shown in FIG. 12, since the BONUS symbols 101 are stopped to be displayed in the third reel display area 33 and the fifth reel display area 35 (S15: YES), the main CPU 41 proceeds to the bonus game process (S16).

When proceeding to the bonus game process (S16), the main CPU 41 initializes the bonus game counter (S41), and then performs the bonus bet setting process (S42). As described above, in the bonus bet setting process, the main CPU 41 sets a free game for the award determination area in which the BONUS symbol 101 is stopped to be displayed and accepts bets for other bet areas.

Here, the bonus bet setting process (S42) will be described in detail with reference to FIG. 13. FIG. 13 is a diagram showing a display form of the lower image display panel 6 at a time when the control proceeds to the bonus game after the display form shown in FIG. 12.

As shown in FIG. 12, since the BONUS symbols 101 are stopped to be displayed in the third reel display area 33 and the fifth reel display area 35, the third reel display area 33 and the fifth reel display area 35 become the bonus areas. Accordingly, the main CPU 41 sets the number of bets (the number of bets of "5") of the third reel display area 33 shown in FIG. 12 for the third reel display area 33 as the number of bets for the free game. At this moment, similar to a case where the game value owned by the player is consumed, for the fifth reel display area 35, the number of bets of "3" for the fifth reel display area 35 shown in FIG. 12 is set without consuming the game value owned by the player.

Then, the main CPU 41 accepts bets of game values for bet areas other than the bonus areas on the basis of the reel selection operation or line selection operation of the player. This feature will be described with reference to FIG. 12 showing a state prior to the transition to the bonus game and FIG. 13 showing a state during the bonus game. As shown in FIG. 12, the number of bets for the eighth reel display area 38 prior to the transition to the bonus game is "0". In FIG. 13 showing a state transited to the bonus game from the state shown in FIG. 12, "3" is set as the number of bets for the eighth reel display area 38. In other words, the case shown in FIG. 13 shows that, in the bonus bet setting process (S42), the player has selected the eighth reel display area 38 by performing the reel selection operation and set "3" as the number of bets for the eight reel display area 38 (S54 to S58).

In addition, in the case shown in FIG. 13, the player places bets for the second reel display area 32, the sixth reel display area 36, the seventh reel display area 37, the eight reel display area 38, the ninth reel display area 39, and the third pay line 84, along with the eight reel display area 38 (see FIGS. 12 and 13).

When the award determination areas are determined by determining the numbers of bets for the bet areas in the bonus bet setting process (S42) as described above, the main CPU 41 performs the symbol determination process (S43) and the symbol display process (S44). In the symbol display process (S44), when the symbols determined in the symbol determination process (S43) are stopped to be displayed in the reel display areas, the main CPU 41 performs the award determination process (S45).

Here, the award determination process (S45) in the bonus game process (S16) will be described in detail with reference to FIG. 13.

In the case shown in FIG. 13, since a bet has been placed for the third pay line 84, a first award determination process is performed for the third pay line 84. As shown in FIG. 13, BARs 93 are stopped to be displayed in the third reel display area 33, the sixth reel display area 36, and the ninth reel display area 39 which constitute the third pay line 84. In other words, in the third pay line 84, a winning combination of "BAR" 93 defined in the first award determination table (see FIG. 9) is achieved. Accordingly, an award of "50" corresponding to the winning combination is determined as the content of the first award and is stored in the RAM 43.

Then, the main CPU 41 performs a second award determination process for the reel display areas corresponding to the award determination areas. In the second award determination process of the bonus game process (S16), similarly to the case shown in FIG. 12, the content of the second award is determined on the basis of the symbols stopped to be displayed in the reel display areas corresponding to the award determination area and the number of bets for the award determination area.

As an example, a case for the fifth reel display area 35 shown in FIG. 13 will be described. As described above, the fifth reel display area 35 in this case is a bonus area, and the number of bets of "3" shown in FIG. 12 is also set in the bonus game process (S16). As shown in FIG. 13, "BLUE 7" 91 is stopped to be displayed in the fifth reel display area 35. Accordingly, the content of the second award for the fifth reel display area 35 is determined to be "60" on the basis of the second award determination table (see FIG. 10).

As described above, the number of bets for the bet area in the previous game is set for the bonus area without consuming the game value owned by the player. In other words, in the case shown in FIG. 13, the player can acquire an award of "60" as the second award without spending the owned game value. After storing the contents of the second prizes for all the award determination areas in the RAM 43, the main CPU 41 completes the award determination process (S45).

Then, the main CPU 41 adds one to the bonus game counter (S46), and repeats the processes of Steps S42 to S46 until the value of the bonus game counter becomes "5".

As described above, in the slot machine 1 according to the embodiment, a bet of a game value can be arbitrary placed for each bet area (S11). In the embodiment, the reel display areas and the pay lines are defined as the bet areas. The reel display areas are the first reel display area 31 to the ninth reel display area 39 each having one symbol display area. The pay lines are the first pay line 82 to the third pay line 84 configured to include a plurality of symbol display areas (in the embodiment, corresponds to a plurality of reel display areas).

Then, in each reel display area, plural types of symbols are variably displayed, and a symbol determined in the symbol determination process (S12) is stopped to be displayed (S13). The slot machine 1 determines the content of the award for the player on the basis of the symbols stopped to be displayed in the symbol display areas (that is, the reel display areas) serving as the award determination areas (that is, the reel display areas and the pay line for which a bet is placed) (S14).

Here, when the BONUS symbol 101 is stopped to be displayed in a reel display area serving as an award determination area (S15: YES), the main CPU 41 gives the player a bonus game as an award for the award determination area (S16).

In the bonus game process (S16), the main CPU 41 set a free game to be performed a predetermined number of times for the bonus areas (that is, a reel display area in which a game value is betted and the bonus symbol 101 is stopped to be displayed or a pay line in which a game value is betted, wherein the bonus symbol 101 is stopped to be displayed in a reel display area serving as the pay line) (S51) and accepts bets of game values for bet areas (that is, the reel display areas and the pay lines) other than the bonus area (S54 to S58).

In other words, when the bonus symbol 101 is stopped to be displayed in the award determination area, the slot machine 1 gives the player a chance for playing a free game as an award. In this bonus game process (S16), a free game is set for the bet area in which the bonus symbol 101 is stopped to be displayed and the player can place a bet of a game value for other bet areas.

Thus, according to the slot machine 1 of the embodiment, a bet operation for any other bet area can be performed while a free game is performed as a bonus game. As a result, according to the slot machine 1 of the embodiment, a situation in which the player only watches symbols variably displayed and symbols stopped to be displayed during a free game performed as a bonus game can be prevented. According to the slot machine 1, the player can aggressively be involved in the free game by performing bet operations for other bet areas.

It is apparent that the present invention is not limited to the above-described embodiment and various types of modifications or changes can be made therein without departing from the scope of the claimed invention.

For example, although the slot machine 1 is so-called a video slot machine in the embodiment, however, the present invention can be applied to a mechanical slot machine.

In addition, although the slot machine 1 is configured to have nine reel display areas including the first reel display area 31 to the ninth reel display area 39 in the embodiment, the number of the reel display areas is not limited to nine. For example, the number of the reels may be configured to be three or five.

In addition, although one reel display area is configured to have one symbol display area in the embodiment, however, the number of the symbol display areas included in one reel display area is not limited thereto. For example, one reel display area may be configured to have three symbol display areas.

In addition, although any limitation is not imposed on placing a bet of a game media for a pay line constituted by three reel display areas in the embodiment, a predetermined condition (for example, so-called a side bet or the like) may be imposed on placing a bet for a pay line.

As described above, in the slot machine according to the embodiment, a bet of a game value is arbitrary placed for each bet area constituted by the symbol display areas. In the symbol display areas, plural types of symbols are variably displayed, and one symbol is stopped to be displayed in each symbol display area. The slot machine provides an award to a player on the basis of symbols stopped to be displayed in the symbol display areas serving as the bet area for which the bet is placed.

Here, when the special symbol is displayed in the symbol display areas serving as a bet area for which the bet is placed, the slot machine sets a free game for the bet area. For bet areas in which symbols other than the special symbol are stopped to be displayed, a bet of a game value from the player is accepted.

Accordingly, the slot machine can give a player a change to be involved in a free game by placing bets for other bet areas in a free game provided on the basis of the special symbol stopped to be displayed.

What is claimed is:

1. A slot machine that provides a slot game to a player, the slot machine comprising:

a display device that is defined with a plurality of symbol display areas in which one of a plurality of types of symbols including a special symbol is respectively displayed stopped after being variably displayed;

an operation unit that allows the player to input commands for playing the slot game; and a game controller that operates to:

accept a bet of a game value on any one or more of a plurality of bet areas that are defined to include the symbol display areas in accordance with the commands input to the operation unit by the player;

determine the symbols to be displayed stopped in each of the symbol display areas;

control the display device to display the determined symbols stopped in each of the symbol display areas after being variably displayed;

determine an award based on the symbols displayed stopped in the bet areas on which the bet is accepted;

provide the determined award to the player;

set a free game for the bet areas on which the bet is accepted and the special symbol is displayed stopped; and accept a next bet on any one or more of the bet areas for which the free game is not set.

2. A slot machine that provides a slot game to a player, the slot machine comprising:

a display device that is provided with a plurality of reel display sections having symbol display area in which one of a plurality of types of symbols including a special symbol is respectively displayed stopped after being variably displayed;

an operation unit that allows the player to input commands for playing the slot game; and a game controller that operates to:

accept a bet of a game value on any one or more of the reel display sections;

determine the symbols to be displayed stopped in each of the reel display sections;

control the display device to display the determined symbols stopped in each of the reel display sections after being variably displayed;

determine an award based on the symbols displayed stopped in the reel display sections on which the bet is accepted;

provide the determined award to the player;

set a free game for the reel display sections on which the bet is accepted and the special symbol is displayed stopped; and accept a next bet on any one or more of the reel display sections for which the free game is not set.

3. A slot machine that provides a slot game to a player, the slot machine comprising:

a display device that is defined with a plurality of symbol display areas in which one of a plurality of types of symbols including a special symbol is respectively displayed stopped after being variably displayed;

an operation unit that allows the player to input commands for playing the slot game; and a game controller that operates to:

accept a bet of a game value on any one or more of a plurality of pay lines that are defined to include the symbol display areas in accordance with the commands input to the operation unit by the player;

determine the symbols to be displayed stopped in each of the symbol display areas;

control the display device to display the determined symbols stopped in each of the symbol display areas after being variably displayed;

determine an award based on the symbols displayed stopped on the pay lines on which the bet is accepted;

provide the determined award to the player;

set a free game for the pay lines on which the bet is accepted and the special symbol is displayed stopped; and accept a next bet on any one or more of the pay lines for which the free game is not set.

* * * * *